US005267888A

United States Patent [19]

Hippely et al.

[11] Patent Number: 5,267,888

[45] Date of Patent: Dec. 7, 1993

[54] TOY VEHICLE HAVING ARTICULATED WHEEL PORTIONS

[75] Inventors: Keith Hippely, Manhattan Beach; Michael T. McKittrick, Torrance; Larry R. Wood, Redondo Beach, all of Calif.

[73] Assignee: Mattel, Inc., El Segundo, Calif.

[21] Appl. No.: 930,586

[22] Filed: Aug. 17, 1992

[51] Int. Cl.[5] ..... A63H 17/26

[52] U.S. Cl. ..... 446/465; 301/32

[58] Field of Search ..... 446/465, 448, 437, 462, 446/431; 301/32, 30; 305/60

[56] References Cited

U.S. PATENT DOCUMENTS

| | | | |
|---|---|---|---|
| 4,424,978 | 1/1984 | Kassai | 446/465 X |
| 4,568,307 | 2/1986 | Gabler et al. | 446/448 |
| 4,643,696 | 2/1987 | Law | 446/465 |
| 4,648,853 | 3/1987 | Siegfried | 446/448 |
| 4,717,367 | 1/1988 | Stubenfoll et al. | 446/437 |
| 4,772,242 | 9/1988 | McKay et al. | 446/448 |
| 4,773,889 | 9/1988 | Rosenwinkel et al. | 446/448 |
| 5,052,680 | 10/1991 | Malewicki et al. | 446/465 X |
| 5,102,367 | 4/1992 | Mullaney et al. | 446/465 X |

*Primary Examiner*—Mickey Yu

*Attorney, Agent, or Firm*—Roy A. Ekstrand

[57] ABSTRACT

A toy vehicle includes a body supported by a plurality of wheels. At least one wheel of the toy vehicle is comprised of a pair of half portions coupled to a pivotal hinge at a common outer edge. One of the half portions is coupled to the vehicle body while the remaining half portion is coupled solely to the pivoting hinge. The wheel portions of the articulated wheel remain closed when the toy vehicle is rolled across a playing surface and separate to form a mouth-like opening when the vehicle or a portion thereof is raised from the play surface.

13 Claims, 2 Drawing Sheets

10
11
12
14
31
23
24
32
13
21
26
25
20
22
18
16
17

41
3
10
11
43
21
42
23
46
25
13
18
33
12
31
20
34
32
26
22
16
17
40
3

TOY VEHICLE HAVING ARTICULATED WHEEL PORTIONS

FIELD OF THE INVENTION

This invention relates generally to toy vehicles and particularly to those having transformable or articulated components.

BACKGROUND OF THE INVENTION

One of the most popular types of toys used by children through the years is that which may be generally described as toy vehicles. Such toy vehicles have been provided in a number of configurations, shapes, sizes and operating characteristics. The complexity of toy vehicles also represents a broad spectrum extending from simple unpowered hand rolled or propelled vehicles to battery powered and remotely controlled complex and expensive vehicles. The appearance characteristics of such toy vehicles extends from miniature replicas of existing vehicles to greatly enhanced fantasy or fanciful vehicles bearing little resemblance to actual full-sized vehicles. In one type of toy vehicle, a plurality of articulated interlocking or cooperating members provide some multiplicity of configurations by which the appearance or function of the toy vehicle is altered.

The object of this substantial effort by practitioners in the art is the provision of increased enjoyment and amusement for the child user. As a result, a virtually endless variety of toy vehicles exists in the art.

For example, U.S. Pat. No. 4,773,889 issued to Rosenwinkel, et al. sets forth a WHEEL FOR A TOY VEHICLE having a center hub attachable to a vehicle axle in a rolling attachment. The center hub supports a pair of spaced apart rim portions and a telescoping mechanism coupled therebetween which permits the spacing between hub portions to be adjusted. A vehicle tire includes a plurality of flexible members extending between the hub portions. When the hub portions are closely spaced, the flexible members are forced outwardly to form a large diameter rolling wheel. Conversely, when the hub portions are spaced apart, the hub portions extend more directly therebetween to form a generally cylindrical wheel.

U.S. Pat. No. 4,643,696 issued to Law sets forth a VEHICLE WHEEL WITH CLUTCH MECHANISM AND SELF-ACTUATED EXTENDING CLAWS in which a vehicle hub supports a plurality of articulated claw members having an outer end and an interior end. The interior end portions are pivotally coupled to the hub such that the outer portions extend outwardly. An outer wheel encloses the hub and defines a plurality of slots which receive the outer ends of the claw members. The rotational position of the interior hub with respect to the outer wheel forces a corresponding extending portion of the claw members outwardly through the outer wheel slots.

U.S. Pat. No. 4,648,853 issued to Siegfried sets forth a WHEEL HUB LOCKING MECHANISM similar to that set forth above in U.S. Pat. No. 4,643,696 in that a vehicle wheel includes an outer wheel having a plurality of slots defined therein and an inner hub is rotatably positionable within the outer wheel. A plurality of extending claw members are pivotally secured to the inner hub at one end and extend outwardly through the slots of the outer wheel in accordance with the rotational position between the inner hub and the outer wheel. A locking mechanism is provided for maintaining the claws in a retracted position.

U.S. Pat. No. 4,717,367 issued to Stubenfoll, et al. sets forth a TOY VEHICLE WITH EXTENDABLE SECTION in which a four-wheeled toy vehicle further includes a two-wheeled tandem section slidably secured to the four-wheel vehicle portion and extendable therefrom to vary the overall length of the vehicle.

U.S. Pat. No. 4,568,307 issued to Gabler, et al. sets forth a PUSH TOY VEHICLE WITH OPERABLE MOUTH having a rear section in the shape of a track vehicle and a front section with operating jaws. The jaws are selectively operable by means supported within the vehicle such that the downward pressure upon the rear vehicle section produces opening of the vehicle mouth.

U.S. Pat. No. 4,424,978 issued to Kassai sets forth a VEHICLE FOR CHILDREN in which a riding vehicle having a fanciful appearance supports a child's seat and a steering wheel. An articulated forward portion of the vehicle is pivotally secured to the vehicle body and moves between an open mouth and close mouth position in response to impact against a forwardly extending bumper or trigger portion.

U.S. Pat. No. 5,052,680 issued to Malewicki, et al. sets forth a TRAILERABLE ROBOT FOR CRUSHING VEHICLES in which a mechanical robot includes hydraulically operated arms, mandible claws, neck, head and jaw resembling a giant prehistoric reptile. The robot is driven from an onboard cockpit and is capable of picking up an automobile and crushing it as well as other play patterns.

U.S. Pat. No. 4,772,242 issued to McKay, et al. sets forth a WHEELED TOY VEHICLE HAVING POUNDING FISTS which includes a support frame and drive wheel rotatably mounted thereon. A pair of forearms are pivotally secured to the frame on opposite sides thereof. Each forearm includes a fist portion which is movable between a raised and lowered position as the vehicle moves to simulate a fist pounding action.

While the foregoing described prior art toy vehicles have provided substantial variety and enjoyment to the child users, there exists, nonetheless, a continuing need in the art for evermore improved interesting and exciting toy vehicles for the child user.

SUMMARY OF THE INVENTION

Accordingly, it is a general object of the present invention to provide an improved toy vehicle. It is a more particular object of the present invention to provide an improved toy vehicle which provides a dramatic transformation of appearance in response to a relatively simple play pattern to facilitate use by younger children or the like.

In accordance with the present invention, there is provided a toy vehicle comprising: a toy vehicle body; a vehicle wheel having a pair of wheel portions and hinge means coupling the wheel portions in a pivotal attachment; and support means for coupling one of the wheel portions to the toy vehicle body.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
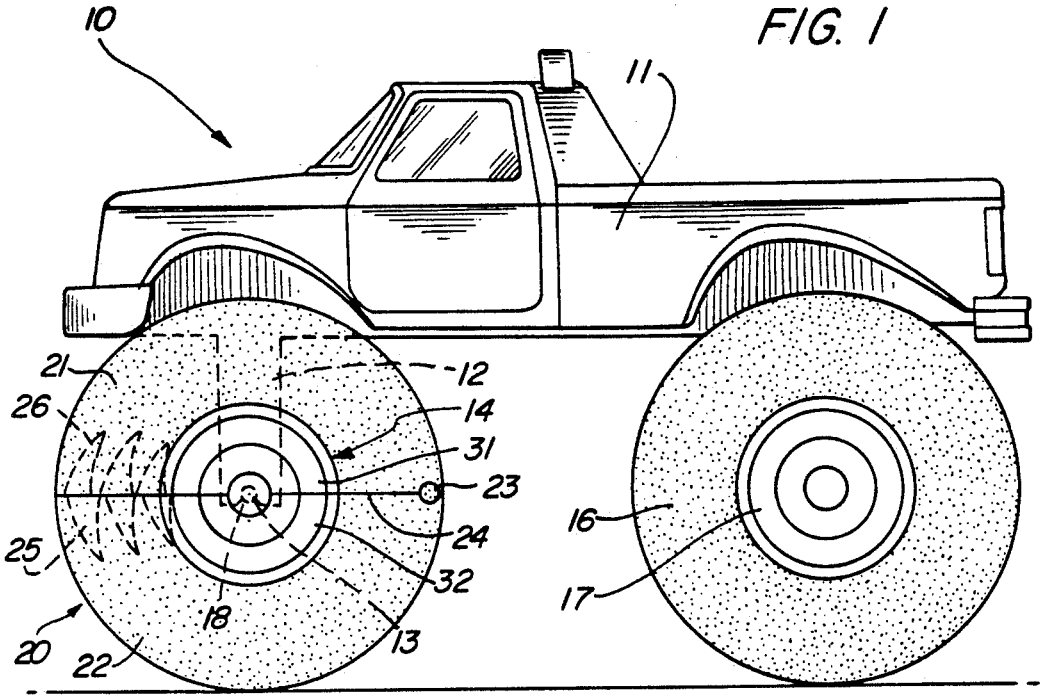
FIG. 1 sets forth a side elevation view of a toy vehicle constructed in accordance with the present invention in a closed wheel position.

FIG. 1 sets forth a side elevation view of a toy vehicle constructed in accordance with the present invention and generally referenced by numeral 10. Toy vehicle 10 includes a body 11 having a downwardly extending axle support 12. Toy vehicle 10 further includes conventional support means not shown which support a pair of rear wheels such as wheel 16 having a center hub such as hub 17. In accordance with the present invention, toy vehicle 10 includes a front wheel generally 15 referenced by numeral 20 having articulated wheel portions 21 and 22. It should be noted that while not seen in FIGS. 1 and 2, the preferred form of toy vehicle 10 includes an additional front wheel identical to front wheel 20 on the opposite side of vehicle body 11. Axle support 12 extends downwardly from the underside of body 11 and defines an axle notch 18 which in turn receives a front axle 13. Front wheel 20 further includes a wheel hub 14 formed of a pair of half portions 31 and 32. In its preferred form, half portion 21 of wheel 20 and half portion 31 of hub 14 are integrally formed. Similarly, half portion 22 of wheel 20 and half portion 32 of hub 14 are also integrally formed. Half portions 21 and 22 of wheel 20 are joined at a hinge attachment 23 and meet along a common seam 24 when configured as shown in FIG. 1. Similarly, half portions 31 and 32 of wheel hub 14 also meet generally along seam 24. A center cap 33 is integrally formed with half portion 31 of wheel hub 14 and receives front axle 13 in a conventional attachment (better seen in FIG. 3). Half portion 21 defines a plurality of interior teeth 25 which in the closed position shown in FIG. 1 are received within the interior of half portion 22 of wheel 20. Similarly, half portion 22 defines a plurality of interior teeth 26 which in the closed position of FIG. 1 are received within half portion 21.

Thus, in the closed position shown in FIG. 1, half portions 21 and 22 of front wheel 20 are joined along seam 24 and secured by hinge 23 to form a generally conventional appearing front wheel. In accordance with the operation of the present invention set forth below in greater detail, toy vehicle 20 may be rolled upon front surface 40 and manipulated by the child user to maintain the closure of half portions 21 and 22 and thus facilitate the rolling conventional play pattern of toy vehicle 10. When configured in the closed position, front wheel 20 gives virtually no indication of its articulated characteristic with the exception of the visibility of seam 24 upon close inspection. However, in its preferred form, front wheel 20 is configured as set forth below in FIG. 3 in greater detail to provide the complete enclosure of teeth 25 and 26 in the closed position shown in FIG. 1.

Figure 2:
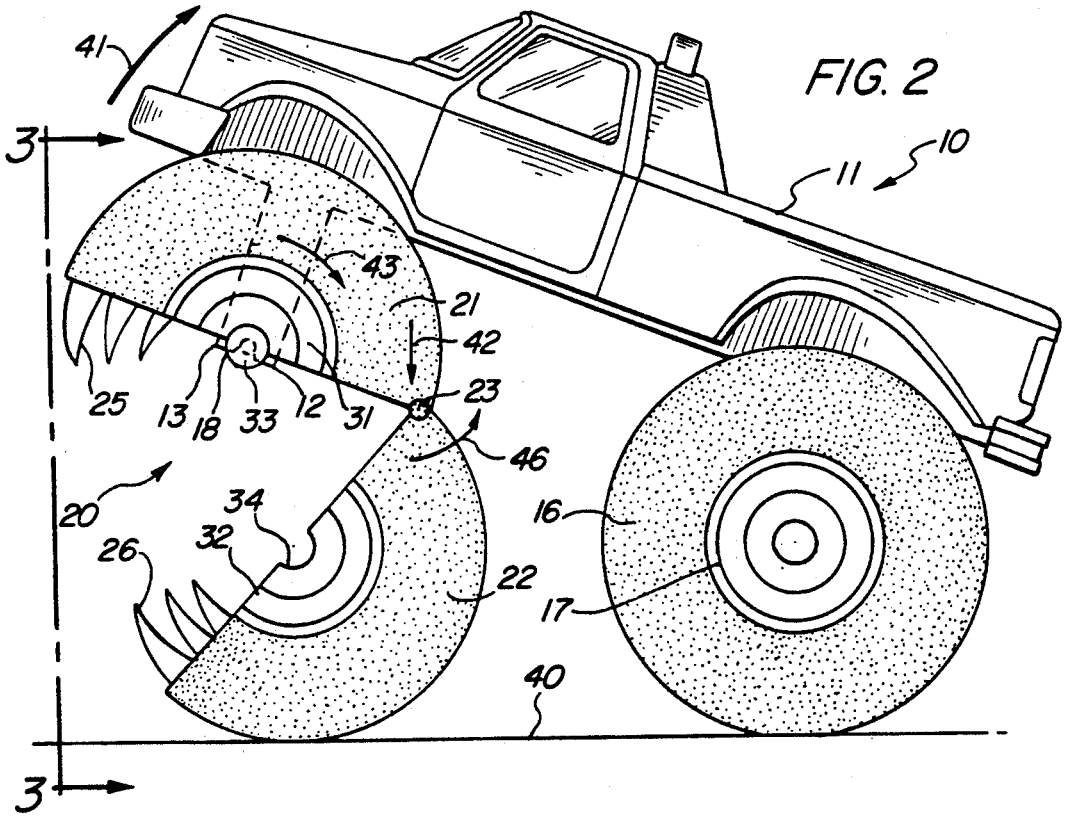
FIG. 2 sets forth the present invention toy vehicle of FIG. 1 in an open wheel configuration.

FIG. 2 sets forth toy vehicle 10 in its alternative configuration in which the articulation of front wheel 20 is visible to present an alternative configuration and appearance for the toy vehicle. Specifically, toy vehicle 10 is constructed in the manner set forth above having a body 11 supported by a plurality of wheels including a pair of conventional rear wheels such as wheel 16 supported by conventional hub portions such as hub 17. Toy vehicle 10 further includes an articulated front wheel 20 and, in its preferred form, an identical similarly articulated and constructed front wheel is supported upon the opposite side of vehicle body 11 (not seen in FIGS. 1 or 2). Body 11 includes a downwardly extending axle support defining an axle notch 18 which receives a front axle 13 in a conventional attachment.

Front wheel 20 includes a pair of half portions 21 and 22 defining respective teeth 25 and 26. Similarly, wheel hub 14 defines half portions 31 and 32 which are preferably formed in an integral manner with half portions 21 and 22 of front wheel 20. Hinge 23, the structure of which is better seen below in FIG. 3, secures half portions 21 and 22 in a pivotal attachment. Half portion 31 of wheel hub 14 further includes an integrally formed center cap 33 which as is better seen below in FIG. 3 receives front axle 13 in a conventional attachment. To accommodate center cap 23 when front wheel 20 is configured in the closed position of FIG. 1, half portion 32 of hub 14 defines a notch 34 which receives a portion of center cap 23 in the closed position of FIG. 1.

In operation, the configuration shown in FIG. 2 is obtained by the user pivoting body 11 about the rear wheels of toy vehicle 10 to raise the front end portion in the direction indicated by arrow 41. In accordance with the preferred structure of the present invention, axle 13 is coupled exclusively to half portion 21 of front wheel 20 leaving half portion 22 coupled and supported solely by hinge 23. As a result, the pivotal motion of toy vehicle 10 in the direction of arrow 41 produces an upward motion of front axle 13 which carries or lifts half portion 21 of wheel 20. The offset attachment of hinge 23 with respect to the supporting attachment of center cap 33 and front axle 13 of front wheel 20 causes the weight of half portion 22 to produce a downward force upon hinge 23 in the direction indicated by arrow 42. As a result, a rotational moment force is created upon half portion 21 which causes it to pivot about front axle 13 in the direction indicated by arrow 43.

Conversely, the pivotal support of hinge 23 couples an upward force upon one side of half portion 22 causing half portion 22 to be pivoted in the direction indicated by arrow 46.

Thus, in accordance with an important aspect of the present invention, the raising of at least the front portion of toy vehicle 10 in the manner shown in FIG. 2 produces pivotal motions of half portions 21 and 22 of front wheel 20 in opposite directions with respect to hinge 23. As a result, the included angle between half portions 21 and 22 increases as the front portion of toy vehicle 10 is raised producing an "open mouth" action between half portions 21 and 22 and exposing teeth 25 and 26. As will be appreciated by those skilled in the art, the appearance associated with the mouth-like opening of the front wheels of toy vehicle 10 exposing the interior previously covered teeth within each of the half portions of the front wheels provides an exciting and dramatic visual effect.

The closure of front wheel 20 is provided by simply pivoting the front portion of toy vehicle body 11 downwardly producing inwardly directed pivotal forces between half portions 21 and 22 about hinge 23 causing closure of the half portions and the restoration of the position shown in FIG. 1. In accordance with the increased interest and amusement value of the present invention toy vehicle, the child user will, after some familiarization, quickly learn to manipulate the articulated front wheels of toy vehicle 10 to move easily between the open position shown in FIG. 2 and the more conventional appearing closed position shown in FIG. 1. As is set forth below in FIGS. 4A through 4D, the present invention toy vehicle is able to roll forwardly without opening the articulated front wheels and thus provide a conventional play pattern when desired by the child user.

Figure 3:
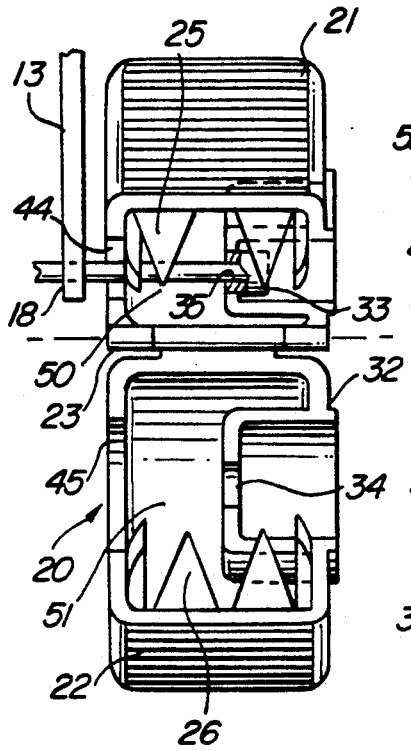
FIG. 3 sets forth a partial front section view of the open wheel portion of the present invention toy vehicle.

FIG. 3 sets forth a partial section perspective view of front wheel 20 in a partially open position. As described above, toy vehicle 10 includes a downwardly extending axle support 12 having an axle notch 18 defined therein. Notch 18 receives and supports a front axle 13 in accordance with conventional fabrication techniques. As is described above, front wheel 20 includes a pair of half portions 21 and 22 secured in a pivotal attachment by a hinge 23. A wheel hub 14 includes a pair of hub portions 31 and 32 which in their preferred form are integrally formed with half portions 21 and 22 of front wheel 20. Hub portion 31 further includes a center cap 33 preferably formed integrally therewith which defines a center bore 35. Bore 35 receives the end portion of front axle 13 and provides a coupling between hub portion 31 and axle 13 which forms the entire support of front wheel 20. Hub portion 31 further defines a notch 44 which provides clearance for front axle 13. Hub portion 32 is preferably formed in an integral fashion with half portion 22 of front wheel 20 and defines a notch 34 which receives center cap 33 in the closed position of front wheel 20 (seen in FIG. 1). Hub portion 32 further defines a notch 45 which provides clearance for front axle 13 when front wheel 20 is operated in the closed position of FIG. 1. Half portions 21 and 22 of front wheel 20 further define interior cavities 50 and 51 respectively as well as a plurality of interior teeth 25 and 26. In accordance with the preferred form of the present invention, the configuration of teeth 25 and 26 is selected to provide a noninterferring closure between half portions 21 and 22 of front wheel 20. Interior cavities 50 and 51 facilitate this noninterferring closure by providing respective cavities which may receive the teeth of the half portions during closure.

FIGS. 4A through 4D set forth simplified diagrams of front wheel 20 which are provided to illustrate the rolling operation of the present invention toy vehicle upon a typical surface generally referenced by numeral 40. To facilitate the explanations which accompany FIGS. 4A through 4D, the spacing between the wheel and hub half portions is exaggerated along seam 24. Thus, it should be understood by those skilled in the art that in the preferred operation of the present invention the half portions of both wheels and hubs are configured to provide a closed seam rather than the exaggerated spacing shown in FIGS. 4A through 4D.

Figure 4A:
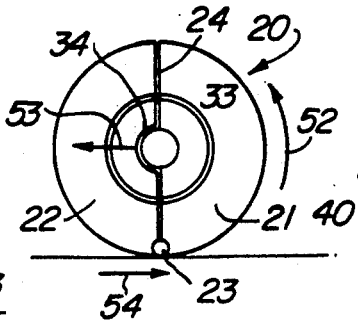
FIGS. 4A, 4B, 4C and 4D set forth the rolling motion behavior of a typical wheel used on the present invention toy vehicle.

Specifically, FIG. 4A sets forth the orientation of wheel 20 during rotation in the direction indicated by arrow 52 along a surface 40. As described above, wheel 20 is formed of a pair of half portions 21 and 22 joined at a hinge 23. Wheel 20 further includes a hub 14 having respective hub portions 31 and 32 integrally formed with wheel portions 21 and 22 respectively. Hub portion 31 includes a center cap 33 while hub portion 32 defines a notch 34 which receives a portion of center cap 33 when wheel 20 is configured in the closed position shown in FIGS. 4A through 4D. In the position shown in FIG. 4A is rotating in the direction indicated by arrow 52 as wheel 20 is being moved along surface 40 in the direction indicated by arrow 53. At the particular rotational position shown in FIG. 4A, hinge 23 is beneath center cap 33. Thus, as rotation continues, a forward force about hinge 23 in the direction of arrow 53 together with the frictional or resisting force between wheel 20 and surface 40 in the direction of arrow 54 cooperates to provide a closure force between half portions 21 and 22.

Figure 4B:
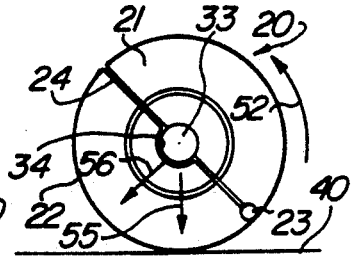

FIG. 4B sets forth the rotational position of wheel 20 as it rotates in the direction indicated by arrow 52 and as wheel 20 rolls upon surface 40. During the portion of rotational motion depicted in FIG. 4B, hinge 23 is positioned beneath and to the rear of center cap 33. During this portion of wheel rotation, the downward force of the vehicle body weight imposed upon wheel 20 produces a force in the direction of arrow 55 which provides continued closure of wheel 20. In addition, the forward motion or driving force applied to the toy vehicle in the direction of arrow 53 (seen in FIG. A) produces a force component in the direction of arrow 56 which also tends to provide closure of half portions 21 and 22 of wheel 20. Thus, with reference to FIGS. 4A and 4B, it will be noted that the forward or driving force applied to the toy vehicle together with the gravitational force provided in a downward direction by the toy vehicle weight provides the closure force which tends to maintain the closure of half portions 21 and 22 of wheel 20.

Figure 4C:
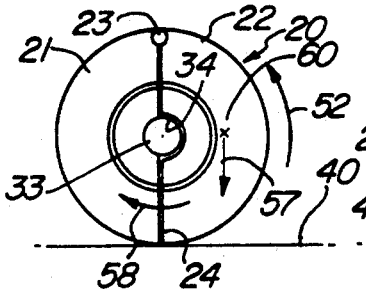

FIG. 4C sets forth the rotational position of wheel 20 generally opposite to that shown in FIG. 4A in which hinge 23 has reached its topmost portion. During the rotational action of wheel 20 at or near the rotational position shown in FIG. 4C, the gravitational force upon half portion 22 of wheel 20 acts generally through the center of gravity thereof indicated by numeral 60 in a downward direction as indicated by arrow 57 to provide a pivotal force about hinge 23 in the direction of arrow 58 which further maintains the closure of half portions 21 and 22 of wheel 20.

Figure 4D:
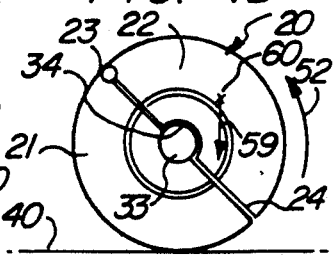

FIG. 4D sets forth the rotational position of wheel 20 as rotation continues in the direction of arrow 52. In the position shown in FIG. 4D, hinge 23 moves ahead of center cap 33. During this rotational position, the gravitational force upon half portion 22 acting through the center of gravity 60 in the direction of arrow 59 continues to provide a rotational force upon half portion 22 in the direction of arrow 58 which in turn acts to maintain the closure of wheel 20.

Thus, in accordance with an important aspect of the present invention, the articulated wheel portions of wheel 20 are maintained and tend to remain in a closed configuration during forward motion of the toy vehicle and thus facilitate the conventional play pattern associated with such toy vehicles as the child user hand pushes or rolls the toy vehicle across a play surface. In accordance with a further advantage of the present invention toy vehicle, the lifting of the toy vehicle portion having articulated wheels such as wheel 20 coupled thereto produces the opening or separating operation shown in FIGS. 1 and 2 to provide the dramatic appearance and configuration change of the present invention toy vehicle. It will be apparent to those skilled in the art that while the present invention toy vehicle has been shown having a generally conventional pair of rear wheels and an articulated pair of front wheels, other combinations may be utilized in different toy vehicle configurations without departing from the spirit and scope of the present invention. Thus, for example, nothing within the present invention toy vehicle prevents or precludes the use of different numbers of articulated wheel combinations such as having as all four wheels of a four wheel vehicle fabricated in accordance with the articulated wheel shown as wheel 20. In addition, the present invention should be understood to be usable in combination with vehicles having two, three or other numbers of supporting wheels without departing from the spirit and scope of the present invention.

Figure 5:
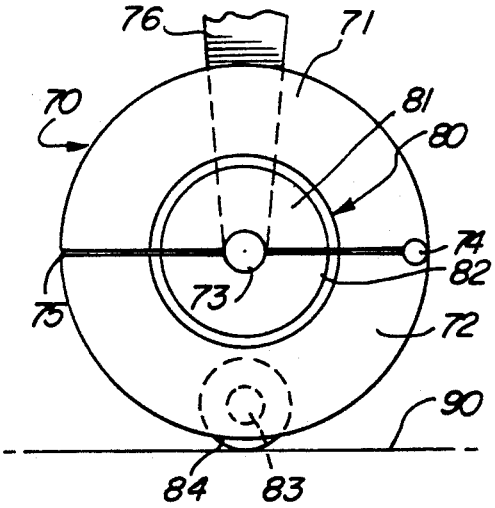
FIG. 5 sets forth a partial view of an alternate embodiment of the present invention toy vehicle in the closed position.
Figure 6:
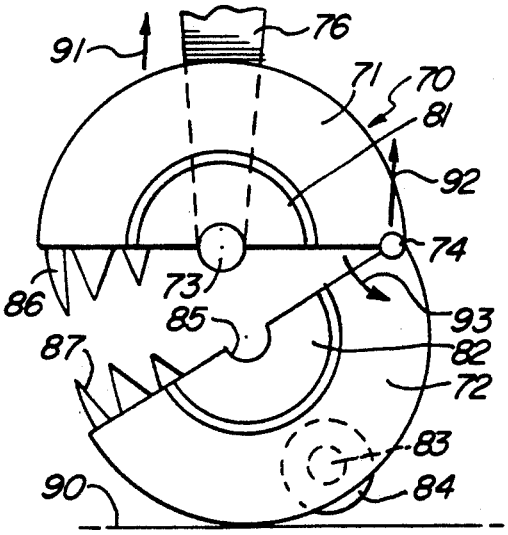
FIG. 6 sets forth the partial view of the alternate embodiment of FIG. 5 in the open wheel configuration.

FIGS. 5 and 6 set forth an alternate embodiment of an articulated wheel for use in accordance with the present invention. Thus, FIGS. 5 and 6 should be understood to set forth an articulated wheel structure which may be used in a toy vehicle in the manner described above for the embodiment shown in FIGS. 1 through 4.

FIG. 5 sets forth an articulated wheel generally referenced by numeral 70 and constructed in accordance with an alternate embodiment of the present invention.

Wheel 70 includes a pair of half portions 71 and 72 pivotally coupled by a hinge 74. Wheel 70 further includes a hub portion 80 formed of half portions 81 and 82. Hub portions 81 and 82 are preferably formed in an integral structure with half portions 71 and 72 respectively of wheel 70. An axle support 76 coupled to a toy vehicle such as toy vehicle 10 (seen in FIGS. 1 and 2) extends downwardly and terminates in a center cap 73. In the embodiment of FIG. 5, axle support 76 and center cap 73 are secured directly to hub portion 81. Accordingly, hub portion 81 and wheel portion 71 are fixed with respect to axle support 76 and are not pivotally movable with respect thereto. A secondary wheel 84 is rotatably coupled to the underside of wheel portion 72 by an axle 83.

In the closed position shown in FIG. 5, wheel portions 71 and 72 together with hub portions 81 and 82 meet at seam 75 extending in a generally horizontal orientation. Wheel 84 provides a rotatable member which permits wheel 70 to be moved upon surface 90 despite the fixed orientation of half portion 71.

FIG. 6 sets forth the open configuration of wheel 70 which results as an upward force in the direction of arrow 91 is applied to wheel 70 through axle support 76. Thus, this upward force may result, for example, when the host vehicle which is supported by wheel 70 is raised in the manner indicated by FIGS. 1 and 2. As mentioned, half portion 71 of wheel 70 remains fixed in a horizontal orientation and is not rotatable with respect to axle support 76. Thus, as wheel 70 is lifted, axle support 76 raises cap 73 and wheel portion 71 in the direction indicated by arrow 91. This upward force is communicated to hinge 74 raising hinge 74 and causing wheel portion 72 to pivot in the direction indicated by arrow 93. The pivotal motion of wheel portion 72 in the direction of arrow 93 separates the wheel and hub portions along seam 75 and provides an open mouth configuration in which a plurality of internal teeth 86 and 87 within wheel portions 71 and 72 respectively becomes visible. A notch 85 formed in hub portion 82 receives and accommodates a portion of center cap 73 in the closed position of FIG. 5. It will be apparent to those skilled in the art that the fixed position of wheel portion 71 requires that all pivotal motion or opening motion of wheel 70 is provided by the pivotal motion of wheel portion 72.

Closure of wheel 70 is provided by simply moving axle support 76 downwardly which causes hinge 74 to be forced downwardly rotating wheel portion 72 toward wheel portion 71 and provide enclosure of wheel 70.

What has been shown is an improved toy vehicle having articulated wheel portions which facilitate an exciting appearance change in a toy vehicle while nonetheless permitting conventional play patterns such as rolling the toy vehicle upon a play surface. A novel articulated wheel formed of pivotally coupled half portions facilitates this dual capability and provides a simple play mechanism for changing configuration which may be utilized by extremely young children.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A toy vehicle comprising:

a toy vehicle body;

a vehicle wheel having a pair of wheel portions and hinge means coupling said wheel portions in a pivotal attachment to form an openable mouth therebetween; and support means for coupling one of said wheel portions to said toy vehicle body.

2. A toy vehicle as set forth in claim 1 wherein said wheel portions define approximate halves of a generally cylindrical wheel defining a generally cylindrical outer surface.

3. A toy vehicle as set forth in claim 2 wherein said hinge means are positioned proximate said outer surface.

4. A toy vehicle as set forth in claim 3 wherein said wheel portions each define a plurality of teeth.

5. A toy vehicle as set forth in claim 4 wherein each of said wheel portions defines an interior cavity for receiving the plurality of teeth of the other of said wheel portions when said wheel portions are closed together.

6. A toy vehicle as set forth in claim 3 wherein said support means includes a rotatable coupling permitting said coupled one of said wheel portions to rotate.

7. A toy vehicle as set forth in claim 6 wherein said support means includes a fixed nonrotational attachment between said coupled one of said pair of wheel portions and said toy vehicle body.

8. A toy vehicle comprising:

a toy vehicle body;

a first pair of wheels rotatably coupled to said toy vehicle body;

a second pair of wheels each having a pair of half portions joined by a hinge and pivotable between a closed and an open position; and support means for coupling one of said half portions of each of said wheels of said second pair of wheels to said toy vehicle body.

9. A toy vehicle as set forth in claim 8 wherein said second pair of wheels each define generally cylindrical wheels having an outer rolling surface.

10. A toy vehicle as set forth in claim 9 wherein said second pair of wheels are supported upon the front portion of said vehicle body.

11. A toy vehicle as set forth in claim 10 wherein said support means includes a rotational coupling member.

12. A toy vehicle as set forth in claim 11 wherein each of said half portions of said wheels in said second pair of wheels include a plurality of teeth.

13. A toy vehicle as set forth in claim 10 wherein said support means include a fixed coupling member.

* * * * *